United States Patent [19]

Troller

[11] 4,023,818

[45] May 17, 1977

[54] TOTE BIN FOR HIGH DENSITY ARTICLES AND MATERIAL HANDLING SYSTEM

[75] Inventor: Robert J. Troller, Madison, Wis.

[73] Assignee: Coolant Equipment Corporation, Verona, Wis.

[22] Filed: June 11, 1976

[21] Appl. No.: 694,953

[52] U.S. Cl. ..... 280/79.1; 206/510
[51] Int. Cl.[2] ..... B62B 5/00
[58] Field of Search ..... 280/79.1 R, 33.99 T, 280/79.2; 206/510, 511, 509; 211/126

[56] References Cited

UNITED STATES PATENTS

| | | | |
|---|---|---|---|
| 2,766,993 | 10/1956 | Reichelt | 280/79.1 R |
| 3,106,332 | 10/1963 | Dieguez | 206/510 |
| 3,118,563 | 1/1964 | Suchodolski | 206/510 |
| 3,372,829 | 3/1968 | Averill | 206/511 |

FOREIGN PATENTS OR APPLICATIONS

| | | | |
|---|---|---|---|
| 1,059,418 | 2/1967 | United Kingdom | 206/510 |

*Primary Examiner*—Robert R. Song
*Attorney, Agent, or Firm*—Theodore J. Long; John M. Winter; Harry C. Engstrom

[57] ABSTRACT

A portable tote bin which may be stacked in vertical registry with similar bins. The bin has a tray section with channeled support members at each end which support the tray in spaced relation to an underlying surface. Inverted U-shaped handles extend upwardly from the tray section, and are insertable within the channeled support members of identical bins for stacking. The handles each have a horizontal transverse segment for engaging and supporting the tray section of a superimposed bin when stacked. An adapter and a dolly combine with the tote bin to provide a material handling system.

7 Claims, 8 Drawing Figures

TOTE BIN FOR HIGH DENSITY ARTICLES AND MATERIAL HANDLING SYSTEM

BACKGROUND OF THE INVENTION

1. Field of the Invention

This invention relates to portable containers, and more specifically to portable supply bins which can be stacked in vertical registry. This invention also pertains to material handling systems for tote bins.

2. Description of the Prior Art

A single container design has not satisfactorily met the needs of in-house storage and movement of high density articles which must be transferred between dispersed use and storage locations. Most container designs emphasize storage space.

One general type of container which has been used for such a purpose is the stackable supply bin. Such supply bins are usually designed to be hard-carried from place to place. Accordingly, the load capacity of such bins is only 40–50 pounds, resulting in very poor space utilization when handling high density materials.

When stacked, arrays of such supply bins have presented both safety and accessibility problems. Their designs have not provided sufficient inherent resistance to tipping, which presents serious problems when the bins are used to store high density products. The conventional "end opening" design has also hindered access to the entire interiors of the bins when stacked in a vertical array.

Accordingly, there is a continuing need for containers which may be easily handled and carried by hand when empty, which may be stacked when empty or full for safe and efficient storage, and which may be moved by conventional powered material handling equipment such as fork-lift trucks, counter-balanced stackers, overhead electric hoists and the like. In addition, it is desirable that the interior of such containers be fully and easily accessible when stacked in a vertical array.

SUMMARY OF THE INVENTION

My invention aims, particularly, at the needs of those practitioners seeking stackable and movable containers for articles which have a high density. The object of my invention is to provide a tote bin for a material handling system in which all articles in all stacked tote bins are accessible, manipulation of the tote bins is readily accomplished via machine or hand power, and the design promotes safe and efficient movement and storage. My system has three kinds of units: a supply or tote bin, an adapter unit for engagement by a hoist, and a platform dolly. Each unit is sturdy, maneuverable and independent, yet specifically compatible for use with the other units of the system.

The tote bin unit has an open-top tray, channeled legs, and handles. The length of the channeled legs provide a separation between the tray and the supporting surface, and between the successive trays in a vertical array or stack. Such separation of bins has two distinct advantages. First, the forks of a lift truck may be inserted below any tray in the array or under the entire array for lifting and transporting. Second, there is convenient access to all of the articles in each bin in an array of bins.

The handles of the bin have a generally inverted U-shape with a horizontal middle (or transverse) segment of extended length. Because the handle shape is coordinated to that of the channeled legs, several desirable characteristics are produced. The horizontal handle transverse segments stabilize the weight distribution of the tray of one bin on the handles of another. The snug fit between the outside dimensions of the handle and the inside dimension of the channel virtually eliminates shifting or shearing between bins in a stacked array. The diagonal dimensions of the handles above the level of the tray substantially exceed the inside width of the channels to prevent any substantial relative tipping of successive bins in an array, and the stacking or unstacking of the bins can be accomplished only by substantially vertical movement on the mating bin structures.

The handles of my tote bin are designed to be quickly, yet securely engageable by the adapter unit of my material handling system. The adapter unit has a pair of side bars which engage the handles of the tote bin, and a cross plate engageable by an overhead hoist. With the adapter unit in place, a tote bin can be moved by means of the hoist, without any sliding occurring between the unit and the handles of the bin. Since the unit and handles do not slide with respect to each other, the articles in the bin are much less likely to slide about while the bin is being moved.

My tote bin may also be engaged upon a platform dolly, supported on casters of appropriate strength, which makes it possible to either roll a bin (or stack of bins) by hand, or to lift and transport the entire array (including the dolly) with a fork lift mechanism. The legs of the tote bin are designed to fit snugly on the frame of the dolly, so that vertical movements are required to set the bin in place or remove it from the frame.

Further objects, features, and advantages of my invention will be apparent from the following detailed description taken in conjunction with the accompanying drawings showing a preferred embodiment of my tote bin and material handling system.

DESCRIPTION OF PREFERRED EMBODIMENT

Figure 1:
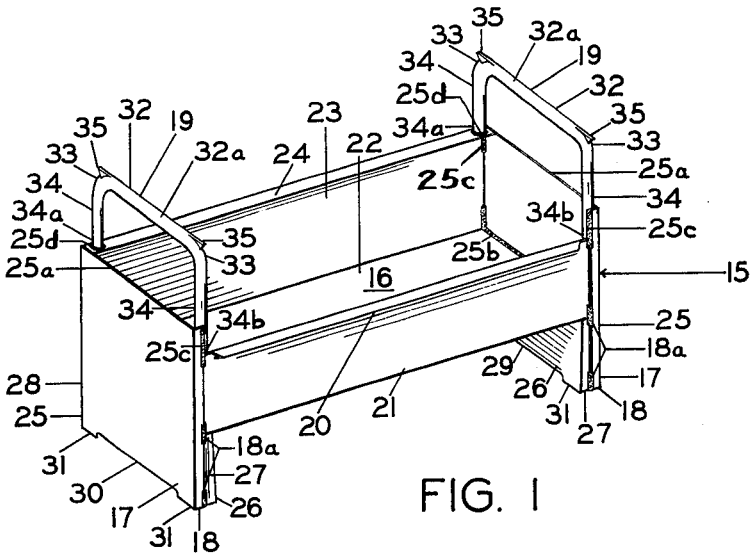
FIG. 1 is a front perspective view of a single tote bin of my invention.

The preferred embodiment of my stackable tote bin 15 is shown in FIG. 1. It is preferably constructed from welded elements of sheet and tubular metal. The principal elements are a tray section 16, a pair of channeled support members 17 with channeled lower portions 18, and a pair of tubular steel inverted-U-shaped handles 19.

The tray 16 is made from a unitary sheet of steel, with appropriate bends to form a small outwardly-projecting front lip 20, a front panel 21, a bottom panel 22, a rear panel 23, and a small inwardly-protruding rear lip 24. The rear panel 23 is higher than the front panel 32. The front lip 20 is designed to facilitate frontward access to the bin 15. The rear lip 24 helps to hold articles in the bin 15 when a stack of filled bins is tipped slightly backward during transport by a forklift truck.

The ends of the tray 16 (as best shown in FIG. 1) are formed by the upward extension 25*a* of the outer channel members 25 of the two support members 17. Each upward extension 25*a* is preferably attached to the tray 16 by a continuous weld 25*b* which extends along the adjacent end of the tray bottom panel 22 for its entire length and further extends partially up the adjacent ends of the front panel 21 and rear panel 23 to provide a fluid-tight joint between the outer channel member 25 and the lower portions of the tray 16. In addition the upward extensions 25*a* are secured to the tubular handles 19 and the upper portions of tray front panel 21 and rear panel 23 by additional welds 25*c*, as required.

Figure 2:
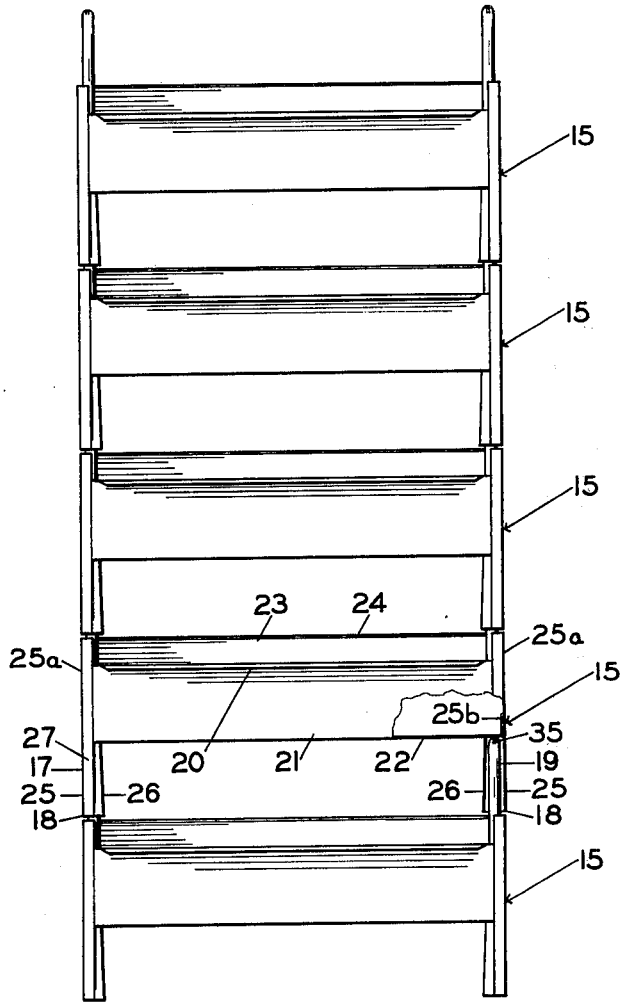
FIG. 2 is a front view of an array of stacked bins, with a cut-away portion showing the relative positioning of a supply bin handle with respect to the underside of the supported tray and channeled leg of the next higher bin.

Each support member 17 has a channeled lower portion 18 (channel) of rectangular cross section, formed by the previously described outer channel member 25 and an inner channel member 26. The outer and inner channel members are secured together and to the tray 16 by welds 18*a* as required. The narrow channels 18 of rectangular cross section are adapted to receive the U-shaped handles of a similar tote bin 15 when it is desired to stack the bins in vertical registry. The dimensions of the rectangular cross section of the channeled lower portion 18 decrease as the channel rises toward the bottom panel 22 of the tray 16. As best shown by the cut-away portion of FIG. 2, the inner channel member 26 is upwardly slanted toward the outer channel member 25 to produce the decrease in cross section. At its upper end immediately below the bottom panel 22 of the tray 16 the inner dimension of the channel 18 is preferably only slightly greater than the external horizontal dimensions of the tubular handle 19.

As described above, the extended outer sides 25*a* of the outer channel member 25 serve as the ends of the supply bin tray 16. The upper edges of the inner channel member 16 abut the underside of the tray bottom panel 22 to serve as additional support therefor and are preferably welded to the bottom panel 22 in a sufficient manner to provide desired rigidity.

In order to inrease the positional stability of the tote bin 15 as it rests on a floor, the bottom edges of the inner 26 and outer 25 channel members have intermediate cut-out sections 29 and 30 respectively. The cutouts 29 and 30 provide separated leg-like projections 31 at the bottom of support members 17. Accordingly, the tote bin 15 will be relatively stable even when resting on surfaces having some irregularities.

Figure 3:
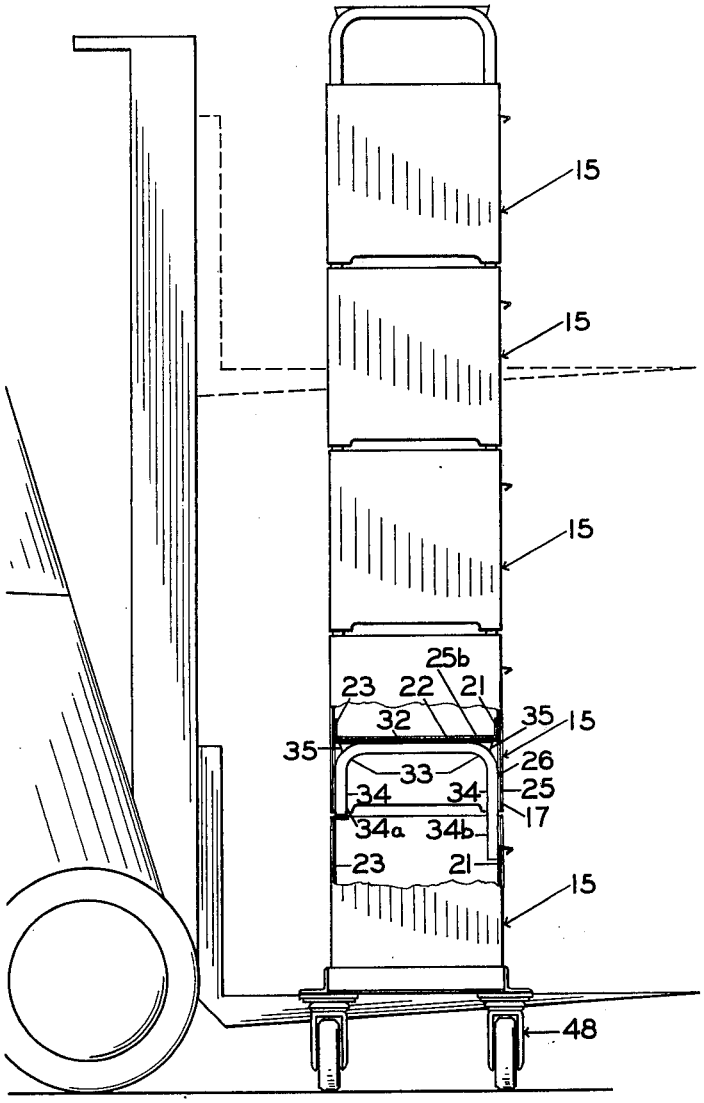
FIG. 3 is an end view of an array of stacked bins, resting on a platform dolly, with a cut-away portion showing the relative positioning of the handles, and further illustrating two of the possible positions for the forks of a lift.
Figure 4:
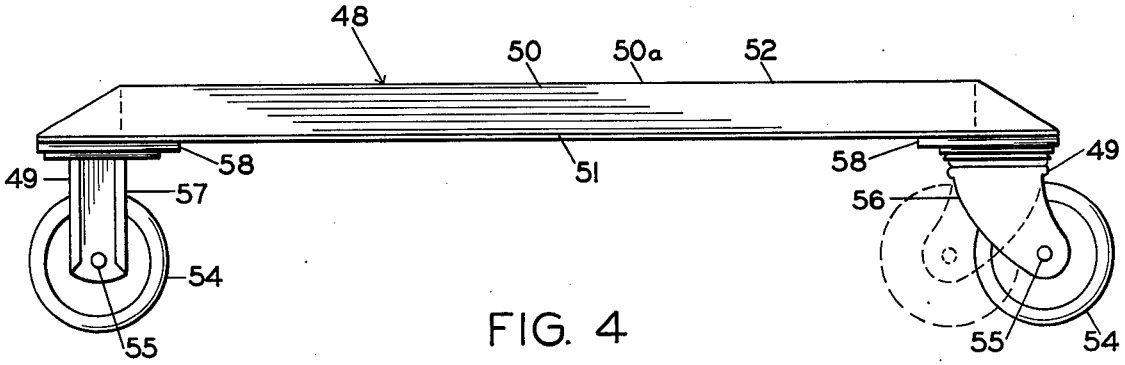
FIG. 4 is a side view of the platform dolly.

As shown in FIG. 1, the tubular handles 19 of the tote bin 15 in my preferred embodiment have the approximate shape of an inverted U, wherein the upper surface 32*a* of the horizontal transverse segment 32 is substantially horizontal. The bends or corners 33 which join the horizontal transverse segment 32 to the two vertical segments 34 are preferably short radius 90° curves. The vertical segment short base 34*a* of each handle 19 is welded to the adjacent end of the tray section rear lip 24 at weld 25*d*. The vertical segment long base 34*b* of each handle 19 is welded to the outer channel member 25 at weld 25*c*. As shown in the cut-away portions of FIGS. 2 and 3, the horizontal transverse segments 32 of handles 19 are designed so that when the handles 19 of one bin 15 are engaged in the channel support members 17 of the next higher bin of a stack, the entire upper surface 32*a* of the flat transverse segment 32 of each handle of the lower bin supports the underside of the bottom panel 22 of the next higher bin.

Figure 8:
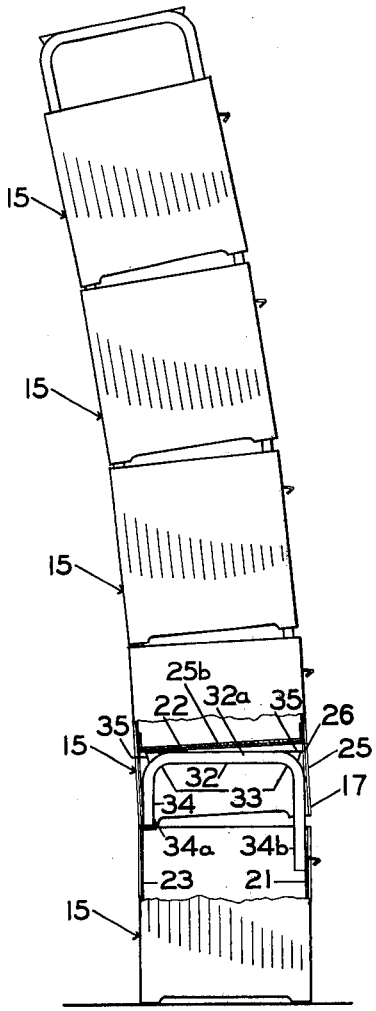
FIG. 8 is an end view of an array of stacked bins illustrating the approximate maximum tipping angle between bins, with a cut-away portion illustrating the structural design features which prevent substantial tipping.

The ears 35 which extend upwardly and outwardly from the outer circumference of the corners 33 of the handles 19, provide extremities of the corners which extend the surface upon which the bottom panel of a supported bin rests. More importantly, however, the corner extremities provided by the ears 35 have a primary safety function. When the supply bins 15 are stacked by lowering the channeled support members 17 of an upper bin onto the U-shaped handles 19 of a lower bin the ears 35 and the longitudinal segments 34 of the handles substantially restrict the movement of the upper bin to the vertical direction. It can be seen from FIG. 3 that the internal longitudinal front to rear dimensions of the channeled support members 17 are only slightly greaer than the external front to rear width of the handles 19 to permit the channeled support members to be vertically engaged upon the handles without binding for ease of stacking and unstacking. However, because my supply bins 15 are designed for containing high density articles, it is very important that my bins positively resist lateral tipping when stacked, and also positively prevent a user from manually disengaging a stacked bin by "rolling" the bin off the stack which rolling action might then cause the contents of the bin to empty onto the user. The handle ears 35 extend outwardly to provide an extremity at each corner 33 of each handle 19 which is spaced a short distance inwardly, as shown, from the maximum horizontal width of the handle to permit a slightly misaligned channeled support member 17 to engage the downwardly sloping outer circumference of the corner 33 of the handle 19 during stacking. Thus, the sloping outer circumference of the corner performs a limited "guide" function for aligning the supported supply bin. However, the handle ears 35 preferably extend a sufficient distance outward as shown in FIG. 8 to provide corner extremities which will prevent a supported supply bin from being "rolled off" or "tipped off" a supporting bin, by engaging and resisting the inner surface of the channeled support member 17 of the supported bin if the supported bin is tipped slightly on the stack. FIG. 8 illustrates how engagement of the ear 35 of the lowest bin in a stack by the supported bin limits the angle of tip of the supported bin. FIG. 8 also illustrates the relationship wherein the diagonal dimension of the handle 19 above the level of the tray 16 substantially exceeds the inside width of the channels 17 to prevent any substantial relative tipping of successive stacked bins, and prevent one bin from being "rolled off" a supported bin. Accordingly, my bins must be engaged and disengaged during stacking and unstacking only by substantially vertical movement of the mating bin structure.

Figure 6:
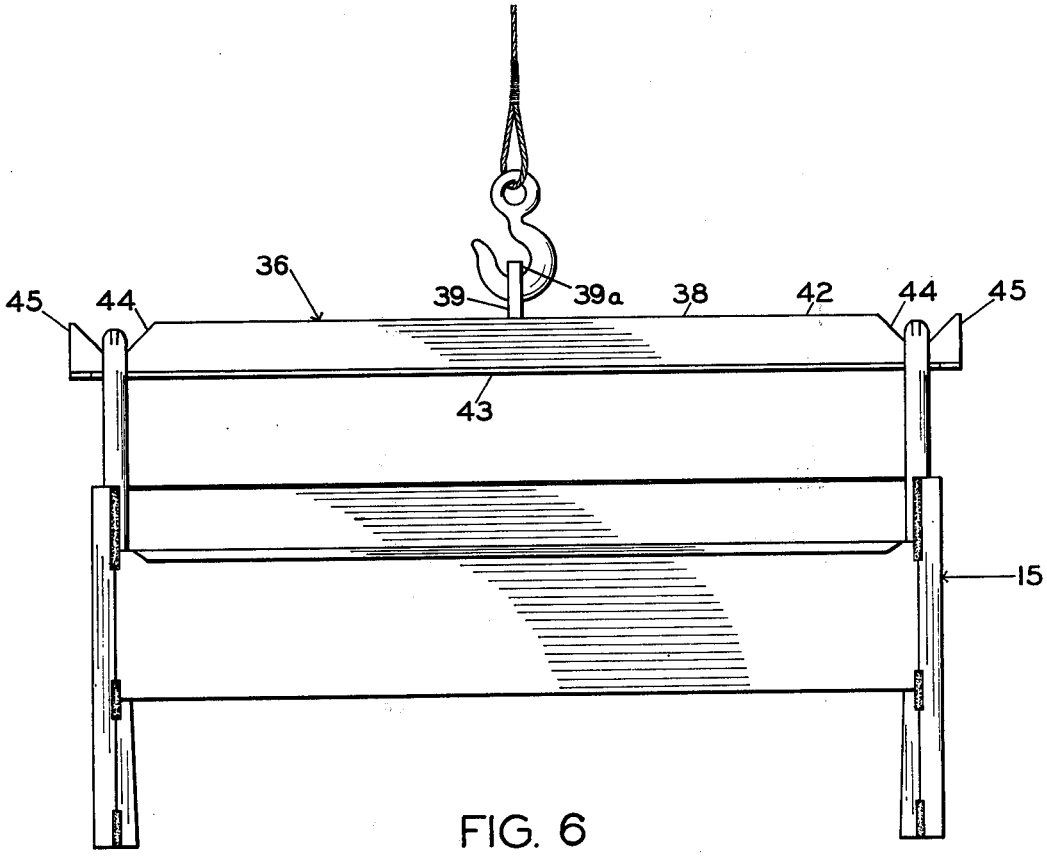
FIG. 6 is a side view depicting a hoist lifting a supply bin by attaching my adapter bar thereto.
Figure 7:
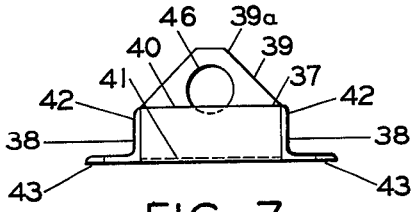
FIG. 7 is an end view of the adapter unit.

The adapter unit 36 designed for overhead transport of my tote bins is a horizontal rectangular frame of conventional 90° angle iron, as illustrated in FIGS. 6 and 7. The adapter unit has a pair of end bars 37, a pair of side bars 38, and a cross plate 39. The end bars 37 of the frame are each positioned so that one leg 40 of each angle iron is upright, and the other leg 41 is horizontally disposed and co-planer with one leg 43 of each of the side bars 38 of the frame. Each side bar 38 also has an upright leg 42. The co-planer legs 41 of the end bars 37 project inward whereas the co-planer legs 43 of the side bars 38 project outward.

As FIG. 6 illustrates, each side bar 38 has a notch 44 in the upper edge of its upright leg 42 near each of its ends 45 to provide handle engaging means. The distance between the notches 44 of each side bar 38 corresponds to the separation of the transverse segments 32 of my tote bin handles 19.

The cross plate 39 extends between and is fastened to the inner surface of the upright leg of each side bar 38 at its midpoint. An upper portion 39*a* of the cross plate 39 extends above the upright legs 42 of the side bar 38, and forms an aperture 46 through which the hook or other supporting coupling device of a hoist can be attached in engagement with the cross plate upper portion 39*a* (see FIG. 6).

When the adapter unit 36 is used to lift a tote bin 15, it is positioned so that the four notches 44 of side bars 38 engage the undersides of the transverse segments 32 of the handles 19. The positive engagement of the handle transverse segments 32 within the notches 44 prevents any horizontal slippage between the adapter unit 36 and the supported tote bin 15.

Figure 5:
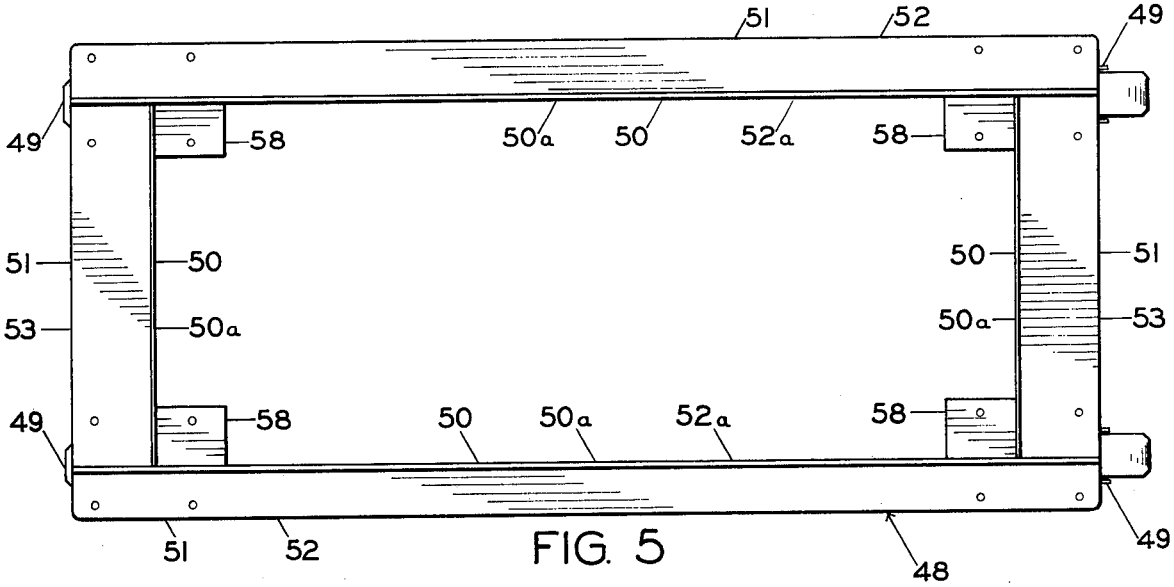
FIG. 5 is a top view of the platform dolly.

The platform dolly unit 48 is comprised of a rectangular frame mounted at each corner on a caster assembly 49. As shown in FIG. 5, the rectangular frame is formed by outwardly facing conventional 90° angle iron side 52 and end 53 members. The upright legs 50 of the frame members form a rectangular receptacle designed to vertically receive the support members 17 of a supply bin 15. In our preferred embodiment, the co-planer horizontal legs 51 of the frame members project outwardly with the outer edges of the two end members 53 abutting the inner faces 52*a* of the upright legs 50 of the side members 52.

The caster assemblies 49 are of conventional design having a wheel 54, axle 55, support fork 56 (rotatable) and 57 (nonrotatable), and platform 58. The support forks 57 at one end of the frame are nonrotatable, and are held so that the axle 55 is parallel to the end members 53 of the frame. As FIG. 6 shows, the platform 58 of each caster assembly 49 is rectangular with the outer three-quarters of the platform supporting and being affixed to the frame members, and the inwardly directed quarter forming a support platform for the channel legs 18 of a tote bin 15 placed within the frame receptacle of the dolly unit 48. The diameter of the wheels 54 is chosen to produce an opening between the bottom of the frame members and the floor sufficiently large to allow the forks of a lift (see FIG. 3) to be inserted therebelow.

The height of the receptacle formed by the upwardly extending angle iron legs 50 is sufficient to prevent any sliding of the tote bin 15 with respect to the dolly unit, but should not extend so high as to prevent the forks of a lift device from being inserted in the gap between the bottom of the supported supply bin 15 and the top edge 50*a* of the dolly frame. Thus, the entire array of bins resting on a dolly 48 may be transported by means of a forklift truck, or the dolly itself may be transported with the array (see FIG. 39).

It is understood that my invention is not confined to the particular construction and arrangement of parts herein illustrated and described, but embraces all such modified forms thereof as come within the scope of the following claims.

I claim:

1. A portable tote bin which may be stacked in vertical registry with similar bins, comprising:
   a. a tray section having a front panel, a bottom panel, and a rear panel;
   b. an inverted-U-shaped support handle extending upwardly from each end of the tray section, each handle having a generally horizontal transverse segment with an upper surface and having a pair of vertical segments each of which has a base affixed to said tray section in supporting relation;
   c. a channeled support member affixed to and extending downwardly from each end of the tray section for supporting the tray section in spaced relation to the bottom of the channeled support members and permitting insertion of power lifting apparatus between the tray section and any plane surface on which the channeled support members might rest, each channeled support member having internal cross-sectional dimensions greater than the external horizontal dimensions of the handles to permit the handles of a similar tote bin to be inserted within the channeled support members, and having internal vertical dimensions less than the vertical distance from the upper surface of the handle transverse segments to the upper edge of the tray;
   d. said channeled support members having outer sides which extend upwardly to the top edge of the tray and which are affixed to the tray to provide closed ends therefor.

2. The portable tote bin specified in claim 1 wherein each handle has corners between the horizontal transverse segment and the two vertical segments thereof, and wherein the diagonal distance from the point of intersection of each vertical segment of the handle with the top of the tray section to the extremity of the corner connecting its other vertical segment to its transverse segment is greater than the internal front-to-rear distance of the channeled support members, to require the handles of one said tote bin to be engaged within the channeled support members of a similar tote bin in a substantially vertical manner and to prevent significant tipping of one tote bin when so engaged upon another.

3. The tote bin specified in claim 2 wherein the handles are formed from tubular material and wherein the extremities of the corners are provided by ears extending from the corners at their outer surface.

4. The tote bin specified in claim 1 wherein the channeled support members have inner sides in opposed spaced relation to the outer sides, and wherein the inner sides are inclined with respect to the outer sides to provide internally tapered channels whereby the channels have a greater width at their lower ends to facilitate entry of the handles of a similar tote bin during stacking and a lesser width at their upper ends to assure vertical alignment of the bins when stacked.

5. The tote bin specified in claim 1 wherein each channeled support member is affixed to the tray by a continuous weld extending along the end of the tray bottom panel and partially up the tray front panel and rear panel to make the lower portion of the tray fluid tight.

6. The tote bin specified in claim 1 including, in combination, an adapter for overhead lifting and transporting of the tote bin comprising, a frame having a pair of spaced side bars, a pair of end bars transversely connecting the respective ends of the side bars and a cross bar transversely connecting the mid-points of the side bars, the side bars each having handle engaging means which are spaced equidistant to the spacing of the tote bin handles for engagement of the handles in secure supporting relation, and the cross bar having means for engagement by a supporting coupling device.

7. The tote bin specified in claim 1 including, in combination, a dolly for supporting and transporting at least one tote bin comprising, a rectangular frame defining a receptacle of sufficient width and length to receive the channeled support members of the tote bin therewithin, a plurality of caster assemblies mounted beneath the frame in supporting relation, the caster assemblies each having a platform secured to the frame for supporting the frame and the tote bin channeled support members within the receptacle and having caster means for supporting the frame in spaced relation to an underlying surface.

* * * * *